US007101012B2

(12) United States Patent
Kosugi et al.

(10) Patent No.: US 7,101,012 B2
(45) Date of Patent: Sep. 5, 2006

(54) CARTRIDGE, PRINTING APPARATUS, AND METHOD OF TRANSMITTING INFORMATION TO AND FROM CARTRIDGE

(75) Inventors: Yasuhiko Kosugi, Nagano-ken (JP); Toshihisa Saruta, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 231 days.

(21) Appl. No.: 10/668,556

(22) Filed: Sep. 22, 2003

(65) Prior Publication Data

US 2004/0114002 A1 Jun. 17, 2004

(30) Foreign Application Priority Data

Sep. 24, 2002 (JP) ..... 2002-277542

(51) Int. Cl.
*B41J 29/393* (2006.01)
*B41J 2/175* (2006.01)
*G03G 15/00* (2006.01)

(52) U.S. Cl. ..... 347/19; 347/86; 399/12

(58) Field of Classification Search ..... 347/7, 347/14, 17, 19, 86, 87; 399/12, 27
See application file for complete search history.

(56) References Cited

U.S. PATENT DOCUMENTS 4,551,734 A * 11/1985 Causley et al. ..... 347/86
5,469,196 A * 11/1995 Okazaki et al. ..... 347/8

FOREIGN PATENT DOCUMENTS

EP 1 080 917 A1 3/2001
JP 2001-147146 A 5/2001

OTHER PUBLICATIONS

Search Report from European Pat. Appln. 03 25 5956.9 (May 13, 2004).

* cited by examiner

*Primary Examiner*—K. Feggins
*Assistant Examiner*—Julian D. Huffman
(74) *Attorney, Agent, or Firm*—Stroock & Stroock & Lavan LLP

(57) ABSTRACT

An ink cartridge 111 holding a recording material used for printing therein has a sensor substitute module 170 to simulate operations of a cartridge having a built-in sensor. As a control circuit 222 of a printer 200 gives a sensor access instruction to the ink cartridge 111, the sensor substitute module 170 generates a specific signal and outputs the specific signal via an output module 178. The specified signal is equivalent to a signal that represents a sufficient level of remaining ink and is expected to be output from the built-in sensor of the cartridge. The ink cartridge 111 is thus applicable to both a printer designed for the use of a cartridge with a built-in sensor and a printer designed for the use of a cartridge without a built-in sensor. Namely the cartridge of the invention is compatible with the cartridge having the built-in sensor.

15 Claims, 10 Drawing Sheets

CARTRIDGE, PRINTING APPARATUS, AND METHOD OF TRANSMITTING INFORMATION TO AND FROM CARTRIDGE

BACKGROUND OF THE INVENTION

1. Field of the Invention

The present invention relates to a cartridge having a chamber that holds a recording material used for printing therein. More specifically the invention pertains to a technique of transmitting information to and from a cartridge without a built-in sensor, which is compatible with a cartridge with a built-in sensor.

2. Description of the Related Art

A diversity of printing apparatuses have been used widely; for example, printing apparatuses that eject inks on printing paper to print images, such as ink jet printers, and printing apparatuses that utilize toners to print images. A cartridge mounted on such a printing apparatus has a chamber to hold a recording material, such as an ink or a toner, therein. Management of the residual quantity of the recording material is an important issue in the printing apparatus. The printing apparatus counts the consumption of the recording material according to a software program for the purpose of management. One known technique uses a sensor mounted on the cartridge for direct measurement of the consumption. This technique is disclosed, for example, in PATENT LAID-OPEN GAZETTE No. 2001-147146.

A variety of sensors may be mounted on the cartridge. When the target recording material to be detected is a conductive ink, the sensor may measure an electric resistance to determine the remaining ink level. Another technique uses a piezoelectric element or another electrostriction element located in a resonance chamber, which is defined in the recording material-holding chamber, and measures the resonance frequency of the electrostriction element to determine the presence or the absence of the recording material in the resonance chamber. The target of measurement may be the temperature, the viscosity, the humidity, the granularity, the hue, the residual quantity, or the pressure of ink or another recording material. In these cases, an exclusive sensor is used for the target physical property to be detected. For example, the sensor may be a thermistor or a thermocouple for measurement of the temperature or may be a pressure sensor for measurement of the pressure.

A cartridge without a built-in sensor may be attached to the printing apparatus designed for the use of a cartridge with a built-in sensor. In such cases, the cartridge does not give a normal response signal and the printing apparatus malfunctions. For example, a cartridge CR2 without a built-in sensor is not applicable to a printing apparatus P1 designed for the use of a cartridge CR1 with a built-in sensor, even when the cartridges CR1 and CR2 have identical specifications except the presence or the absence of the built-in sensor. The printing apparatus P1 has a failure in the sensor-related processing and can not make initialization or continue any further processing. Namely the printing apparatus P1 designed for the use of the cartridge CR1 with the built-in sensor and a printing apparatus P2 designed for the use of the cartridge CR2 without the built-in sensor can not share identical cartridges.

SUMMARY OF THE INVENTION

The object of the invention is thus to provide a cartridge without a built-in sensor, which is applicable to both a printing apparatus designed for the use of a cartridge with a built-in sensor and a printing apparatus designed for the use of the cartridge without the built-in sensor.

In order to attain at least part of the above and the other related objects, the present invention is directed to a cartridge that has a chamber to hold a recording material used for printing therein and is mounted on a printing apparatus. The cartridge includes: a sensor substitute module that substitutes for a sensor, which is not mounted on the cartridge; a condition receiving module that receives an external specification of a detection condition for the sensor; a control module that activates and controls the sensor substitute module, based on the specified detection condition; and an output module that outputs a signal that substitutes for a result of detection and is provided by the sensor substitute module.

The cartridge of the invention does not have a built-in sensor and includes the sensor substitute module that substitutes for the sensor. In response to an external specification of the detection condition for the sensor, the cartridge activates the sensor substitute module based on the specified detection condition and outputs the signal that is provided by the sensor substitute module and substitutes for a result of detection. The printing apparatus receives a result of actual detection from a cartridge with a built-in sensor, while receiving the signal substituting for the result of detection from the cartridge without the built-in sensor. The printing apparatus can thus use both the cartridge with the built-in sensor and the cartridge without the built-in sensor.

One preferable example of the sensor substitute module substitutes for a sensor that detects a status of the recording material held in the chamber. The recording material held in the chamber of the cartridge is, for example, a predetermined color ink used for ink jet printers or a toner used for any of photocopiers, facsimiles, and laser printers.

Another preferable example of the sensor substitute module substitutes for a sensor that detects presence or absence of the recording material in the chamber or a sensor that detects a remaining level of the recording material. The sensor substitute module may be the substitute for a sensor that detects at least one of temperature, viscosity, humidity, granularity, hue, residual quantity, and pressure of the recording material.

In one preferable application of the cartridge, the sensor substitute module generates a signal corresponding to the detection condition received by the condition receiving module. Either or both of the sensor substitute module and the control module may be constructed as an arithmetic and logic circuit.

In one preferable embodiment of the cartridge, the sensor substitute module substitutes for a sensor that detects presence or absence of the recording material in the chamber according to a variation in resonance frequency of a piezoelectric element, and outputs a signal corresponding to a value of the resonance frequency representing the presence of the recording material in the chamber.

In the cartridge of this embodiment, the condition receiving module receives a specified number of vibrations of the piezoelectric element as the detection condition to measure a time required for the specified number of vibrations, and the control module activates the sensor substitute module to generate vibration-related data corresponding to the time required for the specified number of vibrations. The cartridge of this arrangement substitutes for a cartridge with a built-in sensor that actually measures the time required for the specified number of vibrations.

In one preferable application of this embodiment, the specified number of vibrations received by the condition receiving module is defined by specified positions of a measurement starting vibration and a measurement terminating vibration, and the control module activates the sensor substitute module to generate the vibration-related data, based on the specified positions of the measurement starting vibration and the measurement terminating vibrations. The cartridge of this arrangement functions as the cartridge with the built-in sensor.

The cartridge may further include a memory that stores a parameter corresponding to a status of the recording material held in the chamber.

The cartridge of the invention may receive the specification of the detection condition via wireless communication. For this purpose, the cartridge may have a wireless communication module that receives and transmits data from and to the outside of the cartridge by wireless communication. In this structure, the result of detection is also output via wireless communication.

In one general structure, the wireless communication module has a loop antenna that effectuates the wireless communication. An electromotive force is induced in the loop antenna in the course of communication. The electromotive force may be utilized for supply of electric power to the cartridge. The cartridge of this arrangement does not require any built-in battery and accordingly has the simplified structure.

Another application of the present invention is a printing apparatus using the cartridge of any of the above arrangements. The present invention is thus directed to a printing apparatus with a cartridge mounted thereon, where the cartridge has a chamber that holds a recording material used for printing therein.

The cartridge includes: a sensor substitute module that substitutes for a sensor, which is not mounted on the cartridge; a condition receiving module that receives an external specification of a detection condition for the sensor; a control module that activates and controls the sensor substitute module, based on the specified detection condition; and an output module that outputs a signal that substitutes for a result of detection and is provided by the sensor substitute module. The printing apparatus includes: a condition specification module that specifies the detection condition; an input module that receives the signal output from the output module of the cartridge; and a decision module that makes a decision on the assumption of a detection with the sensor, which is not mounted on the cartridge, in response to the input signal.

The cartridge mounted on the printing apparatus does not have a built-in sensor and includes the sensor substitute module that substitutes for the sensor. In response to a specification of the detection condition for the sensor from the printing apparatus, the cartridge activates the sensor substitute module based on the specified detection condition and outputs the signal that is provided by the sensor substitute module and substitutes for a result of detection. The printing apparatus receives a result of actual detection from a cartridge with a built-in sensor, while receiving the signal substituting for the result of detection from the cartridge without the built-in sensor. The printing apparatus can thus use both the cartridge with the built-in sensor and the cartridge without the built-in sensor.

The technique of the present invention is not restricted to the cartridge of the various arrangements discussed above or the printing apparatus with such a cartridge mounted thereon, but is also applicable to an information transmission method. The present invention is thus directed to an information transmission method that transmits information to and from a cartridge having a chamber that holds a recording material used for printing therein. The information transmission method includes the steps of: receiving an external specification of a detection condition for a sensor, which is not mounted on the cartridge, from outside of the cartridge; and outputting to the outside of the cartridge a signal generated by a sensor substitute module, which is mounted on the cartridge as a substitute for the sensor, according to the externally specified detection condition.

According to the information transmission method of the invention, as the outside of the cartridge gives an external specification of a detection condition for a sensor, which is not mounted on the cartridge, the cartridge outputs a signal generated by the sensor substitute module, which is mounted on the cartridge as the substitute for the sensor, according to the specified detection condition. The outside of the cartridge then receives the signal substituting for a result of detection under the specified detection condition.

These and other objects, features, aspects, and advantages of the present invention will become more apparent from the following detailed description of the preferred embodiment with the accompanying drawings.

DESCRIPTION OF THE PREFERRED EMBODIMENTS

Figure 1:
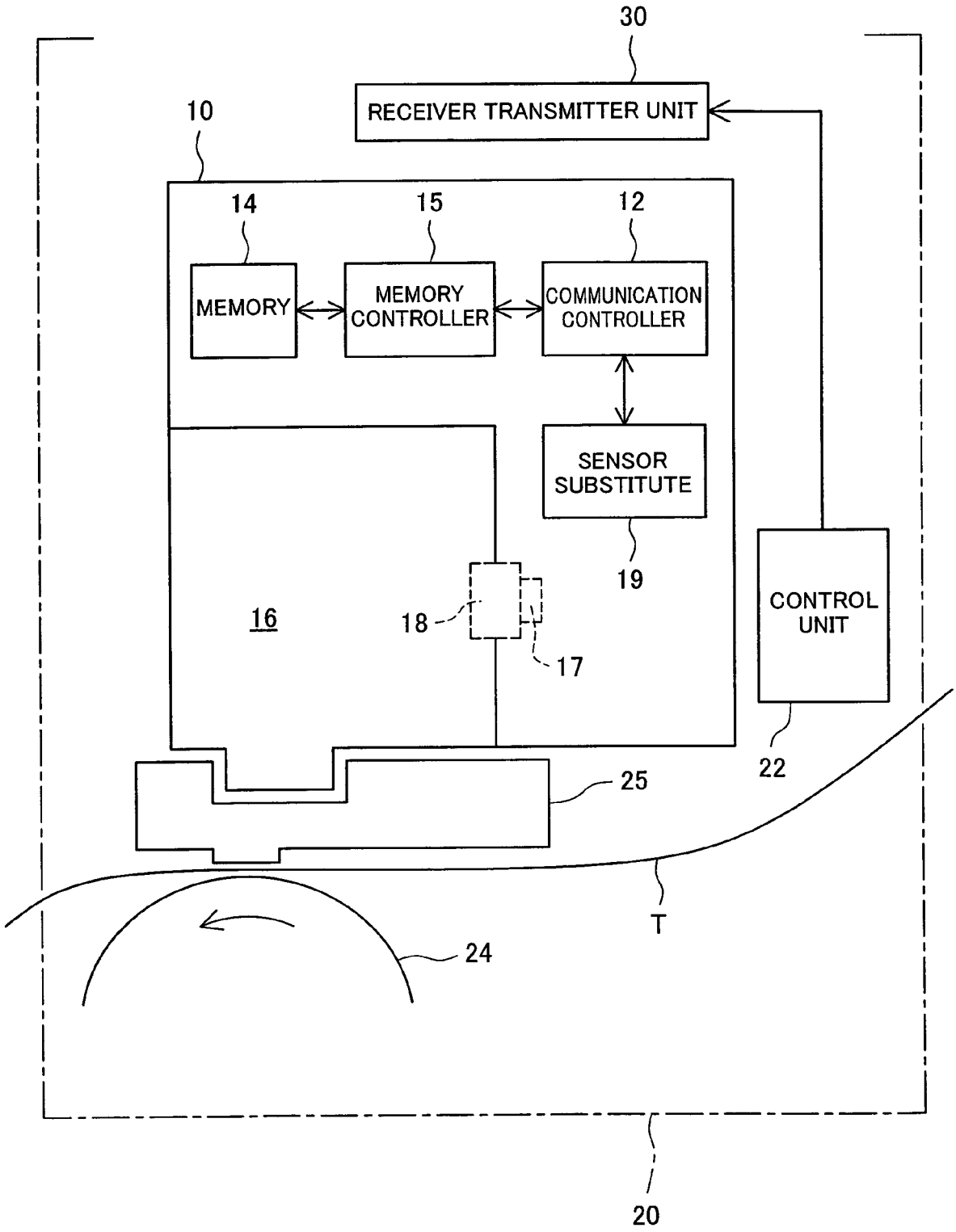
FIG. 1 schematically illustrates the structure of an ink cartridge and a printer, to which the ink cartridge is attached, in one mode of the invention.

FIG. 1 schematically illustrates the structure of an ink cartridge 10 and a printer 20 with the ink cartridge 10 mounted thereon in one mode of the invention. The printer 20 makes ink ejected from a print head 25 and thereby prints an image on printing paper T, which is fed by means of a platen 24. The printer 20 includes a control unit 22, although the internal structure of the printer 20 is not described nor illustrated specifically. The control unit 22 computes an ink consumption used for printing and other required data and transmits the computed data to the ink cartridge 10 via a receiver transmitter unit 30. Data are transmitted between the printer 20 and the ink cartridge 10 by wireless, although wire communication may be adopted instead. The electromagnetic induction technique is applied for wireless communication in this mode of the invention, though another technique is also applicable.

The ink cartridge 10 includes a communication controller 12 that controls communication, a memory controller 15 that controls reading and writing data from and into a memory 14, and a sensor substitute 19 that substitutes for a sensor, which is not mounted on the cartridge 10. For the better understanding of the functions of the sensor substitute 19, the structure and the operations of the sensor, which is substituted by the sensor substitute 19, are discussed first. Some ink cartridge that is compatible with the ink cartridge 10 may have a sensor 17 to detect a remaining ink level in an ink chamber 16, as shown by the broken line in FIG. 1. The ink cartridge with the built-in sensor 17 detects the remaining ink level in the ink chamber 16 according to the following procedure. The sensor 17 as a piezoelectric element is attached to a resonance chamber 18 provided in the ink chamber 16. The sensor 17 is strained and deformed by application of a driving voltage to electrodes (not shown). Discharge of electric charges accumulated in the piezoelectric element in this state releases the deforming energy and causes free vibration of the piezoelectric element. The sensor 17 faces the resonance chamber 18, so that the frequency of the free vibration is restricted by a resonance frequency of the resonance chamber 18. The resonance frequency of the resonance chamber 18 is varied according to the status of ink presence or ink absence in the resonance chamber 18. Detection of the resonance frequency accordingly specifies the status of ink presence or ink absence in the resonance chamber 18 or more specifically the remaining ink level in the ink cartridge 10.

The ink cartridge 10 actually does not have the built-in sensor 17, and the sensor substitute 19 outputs a substitute for a detection result, that is, the detection of the remaining ink level with the sensor 17. The sensor substitute 19 receives a sensor activation instruction from the control unit 22 via the communication controller 12, analyzes the input instruction, and outputs a signal substituting for a detection result of the sensor 17 to the control unit 22 via the communication controller 12 and the receiver transmitter unit 30. In order to enable the printer 20 with the cartridge 10 mounted thereon to continue the operations, the sensor substitute 19 outputs a signal that is equivalent to a signal output from the sensor 17 in the status of ink presence in the ink chamber 16. The control unit 22 of the printer 20 receives the signal and continues the operations of the printer 20 on the assumption that a sufficient level of ink remains in the ink cartridge 10. The control unit 22 of the printer 20 generally manages the residual quantity of ink by the software. The signal representing the status of ink presence or ink absence from the ink cartridge 10 is used as an ink end signal to inform the user of an ink end-approaching status or used to check the software-based management. The control unit 22 continues the processing, while a dummy signal, which does not correspond to the actual residual quantity of ink in the ink chamber 16, is continuously output from the ink cartridge 10.

Figure 2:
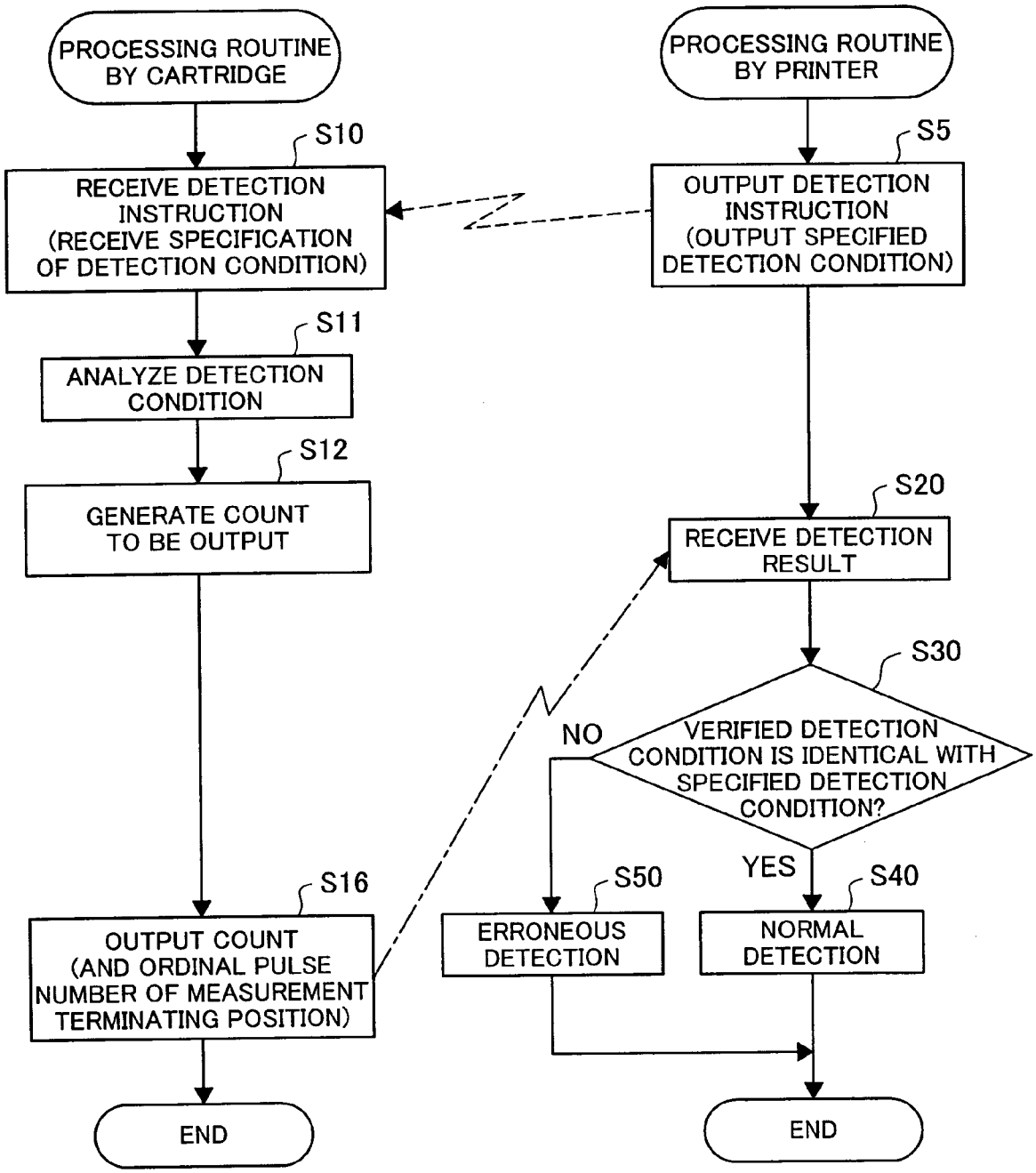
FIG. 2 is a flowchart showing a series of processing executed by a sensor substitute of the ink cartridge, in combination with a series of processing executed by a control unit of the printer.

FIG. 2 is a flowchart showing a series of processing executed by the sensor substitute 19 of the ink cartridge 10, in combination with a series of processing executed by the control unit 22 of the printer 20. The sensor substitute 19 is constructed by an arithmetic and logic circuit in this mode of the invention, but may be actualized by a circuit structure including a gate array. In the sequence of processing shown in FIG. 2, the control unit 22 of the printer 20 sends an instruction for detecting the remaining ink level and a specification of a detection condition (step S5). The ink cartridge 10 receives the instruction for detecting the remaining ink level and the specified detection condition via the communication controller 12 (step S10). The detection condition is, for example, a time period required for output of 4 pulses from the $1^{st}$ pulse of resonance, when the sensor substitute 19 substitutes for a piezoelectric element-type sensor.

The sensor substitute 19 analyzes the received detection condition (step S11). In this example, the detection condition is specified by the $1^{st}$ pulse as a measurement starting pulse and 4 pulses as the number of measuring pulses. The sensor substitute 19 then generates a signal to be output from the ink cartridge 10 corresponding to the detection condition (for example, the 4 pulses from the $1^{st}$ pulse), that is, a count representing a time period corresponding to the number of measuring pulses (step S12). The specification of the detection condition determines a signal to be output from the ink cartridge 10 in the status of ink presence in the ink chamber 16. The sensor substitute 19 thus readily generates the signal or the count that is equivalent to the signal output in the status of ink presence. The count may be generated by an arithmetic and logic circuit, or a counter with a preset count may be used instead. The sensor substitute 19 outputs the generated count and an ordinal pulse number of a measurement terminating position (step S16). The ordinal pulse number of the measurement terminating position is obtained by adding the number of measuring pulses (4 pulses in this example) to the measurement starting pulse (the $1^{st}$ pulse of resonance in this example) and is equal to the $5^{th}$ pulse in this example.

The control unit 22 of the printer 20 receives the count as a detection result and the ordinal pulse number output from the sensor substitute 19 via the communication controller 12 (step S20). The control unit 22 verifies the ordinal pulse number received with the count and determines whether or not the verified detection condition is identical with the specified detection condition (step S30). In this example, the control unit 22 receives the ordinal pulse number corresponding to the measurement terminating position from the sensor substitute 19 of the ink cartridge 10. The control unit 22 computes the position of a measurement terminating pulse from the specification of the detection condition (step S5), compares the computed position of the measurement terminating pulse with the received ordinal pulse number, and determines whether or not the verified detection condition is identical with the specified detection condition. According to one possible modification, the control unit 22 of the printer 20 may specify a measurement starting pulse and a measurement terminating pulse and receive and verify the number of measuring pulses.

The sensor substitutes 19 sends back the correct detection condition to the control unit 22. The verified detection condition is thus generally identical with the specified detection condition, and the control unit 22 determines that detection is normal (step S40). In this case, the detection result representing the remaining ink level is usable for the subsequent processing. For example, when the signal output as the substitute for the detection result represents the status of ink presence in the resonance chamber 18, the control unit 22 of the printer 20 determines that the remaining ink level keeps the level of the resonance chamber 18 and continues counting the remaining quantity of ink by the software.

When the verified detection condition based on the signal input from the in cartridge 10 is not identical with the specified detection condition, on the other hand, the control unit 22 determines that detection is erroneous (step S50). In this case, the detection result is not used for the subsequent processing. Unless there is any failure in the ink cartridge 10 including the sensor substitute 19, the verified detection condition is identical with the specified detection condition.

In this mode of the invention discussed above, the ink cartridge 10 without a built-in sensor includes the sensor substitute 19 and is thus usable for a printer designed for an ink cartridge with a built-in sensor. The ink cartridge 10 without a built-in sensor is applicable to even a printer that is designed to output a detection condition to a built-in sensor of an ink cartridge and activate the built-in sensor under the detection condition or to a printer that is designed to verify information that corresponds to the specified detection condition and is sent back from the cartridge with the built-in sensor. The printer designed for an ink cartridge with a built-in sensor and the printer designed for an ink cartridge without a built-in sensor can thus share the identical ink cartridge 10.

In the mode discussed above, wireless communication is applied for data transmission between the ink cartridge 10 and the printer 20. There is accordingly no possibility of a failed contact between the printer 20 and the ink cartridge 10, which shifts in the course of printing. This arrangement thus ensures stable data transmission. In this mode of the invention, the ink cartridge 10 outputs the data representing the specified detection condition together with the detection result, and the control unit 22, which has specified the detection condition, verifies the data. The arrangement ensures the high reliability of data communication as well as detection, although this is not essential for the present invention.

Figure 3:
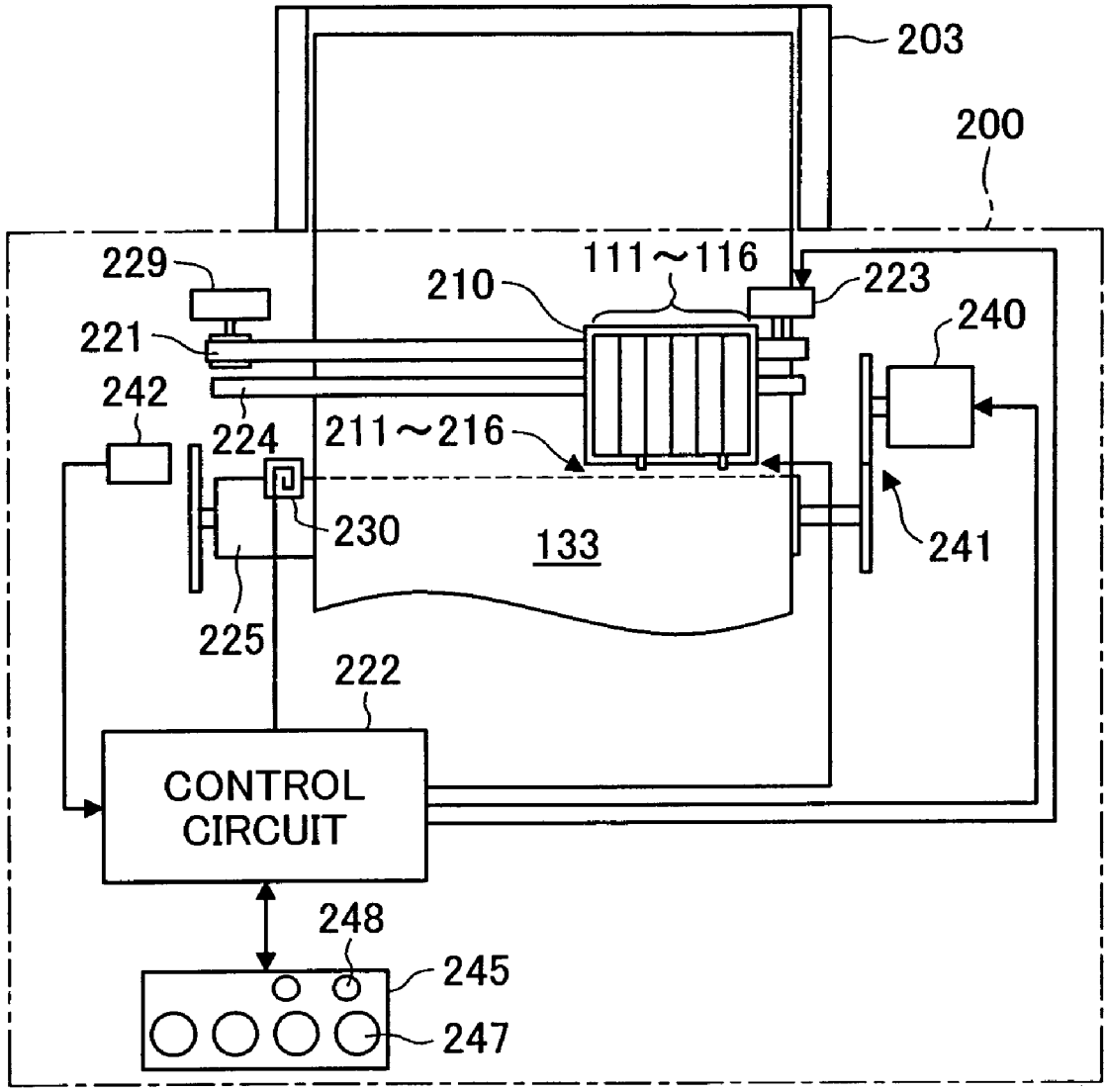
FIG. 3 schematically illustrates the structure of an ink jet printer in one embodiment of the invention.
Figure 4:
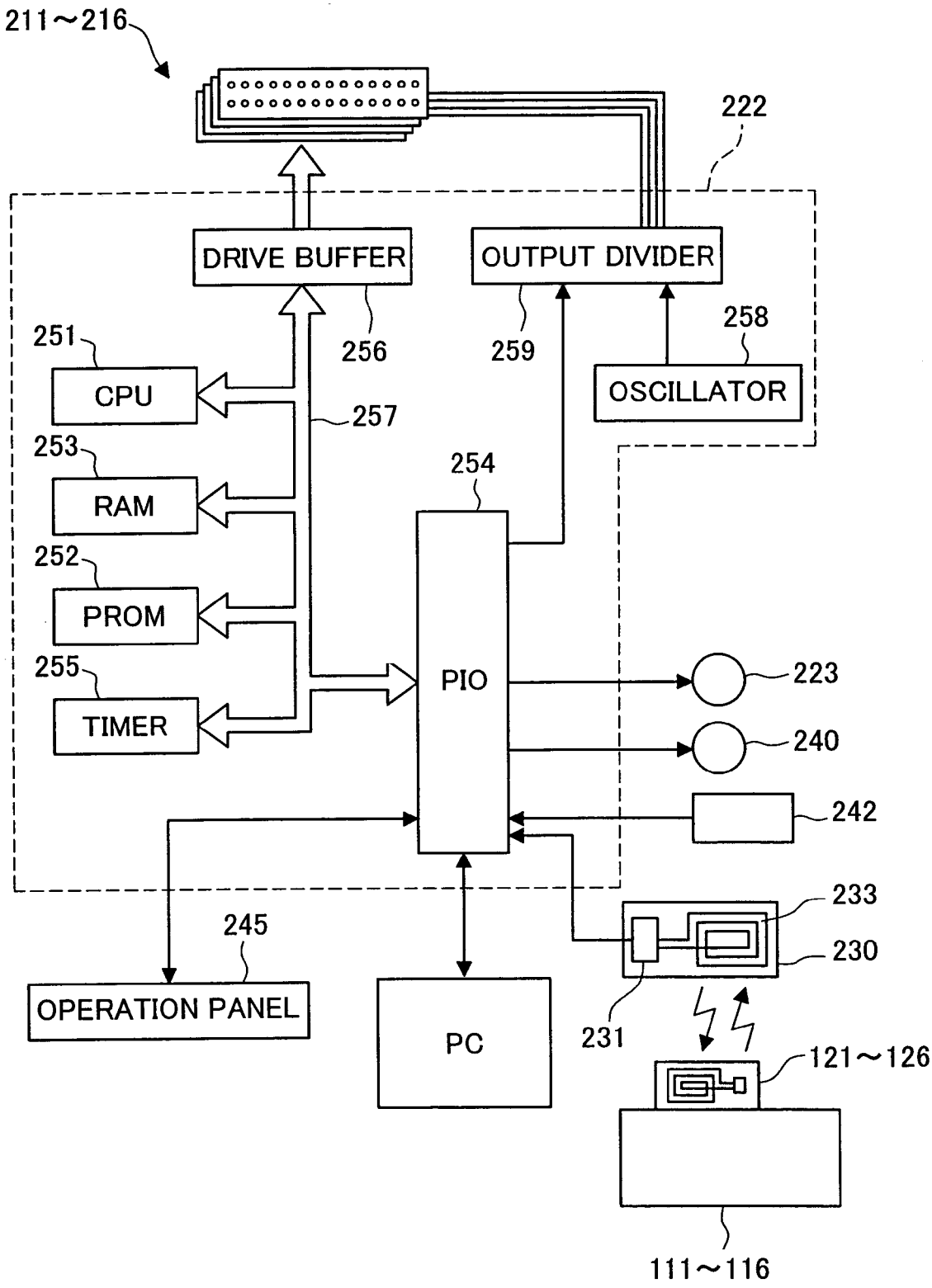
FIG. 4 shows the electric construction of a control circuit included in the printer of the embodiment.

This technique of the invention is applicable to various printers. The following describes application of the invention to an ink jet printer 200 as one embodiment. FIG. 3 schematically illustrates the structure, especially the operation-related structure, of the ink jet printer 200. FIG. 4 shows the electric construction of a control circuit 222 of the printer 200. As shown in FIG. 3, the printer 200 makes ink droplets ejected from print heads 211 through 216 onto printing paper T, which is fed from a paper feed unit 203 and is transported by means of a platen 225, so as to form an image on the printing paper T. The platen 225 is actuated and rotated by the driving force transmitted from a paper feed motor 240 via a gear train 241. The rotational angle of the platen 225 is measured by an encoder 242. The print heads 211 through 216 are mounted on a carriage 210, which moves back and forth along the width of the printing paper T. The carriage 210 is linked with a conveyor belt 221, which is actuated by a stepping motor 223. The conveyor belt 221 is an endless belt and is spanned between the stepping motor 223 and a pulley 229 arranged on the opposite side. With rotations of the stepping motor 223, the conveyor belt 221 moves to reciprocate the carriage 210 along a conveyor guide 224.

Ink cartridges 111 through 116 of six different color inks are attached to the carriage 210. The six color ink cartridges 111 through 116 basically have an identical structure and respectively store inks of different compositions, that is, inks of different colors, in their internal ink chambers. More specifically, the ink cartridges 111 through 116 respectively store black ink (K), cyan ink (C), magenta ink (M), yellow ink (Y), light cyan ink (LC), and light magenta ink (LM). The light cyan ink (LC) and the light magenta ink (LM) are regulated to have ¼ of the dye densities of the cyan ink (C) and the magenta ink (M). Storage process modules 121 through 126 (discussed later) are attached to these ink cartridges 111 through 116, respectively. The storage process modules 121 through 126 transmit data to and from the control circuit 222 of the printer 200 by wireless communication. In the structure of this embodiment, the storage process modules 121 through 126 are attached to the respective side planes of the ink cartridges 111 through 116.

The printer 200 has a receiver transmitter unit 230 to establish wireless communication with and data transmission to and from these storage process modules 121 through 126. The receiver transmitter unit 230, as well as the paper feed motor 240, the stepping motor 223, the encoder 242, and the other electronic parts, are connected to the control circuit 222. Diverse switches 247 and LEDs 248 on an operation panel 245 located on the front face of the printer 200 are also connected with the control circuit 222.

As shown in FIG. 4, the control circuit 222 includes a CPU 251 that controls the constituents of the whole printer 200, a ROM 252 that stores control programs therein, a RAM 253 that is used to temporarily register data, a PIO 254 that functions as an interface with external devices, a timer 255 that manages the time, and a drive buffer 256 that stores data for driving the print heads 211 through 216. These circuit elements are mutually connected via a bus 257. The control circuit 222 also includes an oscillator 258 and an output divider 259, in addition to these circuit elements. The output divider 259 distributes a pulse signal output from the oscillator 258 into common terminals of the six print heads 211 through 216. Each of the print heads 211 through 216 receives dot on-off data (ink ejection non-ejection data) from the drive buffer 256 and makes the ink ejected from corresponding nozzles according to the dot on-off data received from the drive buffer 256 in response to driving pulses output from the output divider 259.

A computer PC that outputs object image data to be printed to the printer 200, as well as the stepping motor 223, the paper feed motor 240, the encoder 242, the receiver transmitter unit 230, and the operation panel 245 are connected to the PIO 254 of the control circuit 222. The computer PC specifies an object image to be printed, makes the specified object image subjected to required series of processing, such as rasterizing, color conversion, and halftoning, and outputs resulting processed data to the printer 200. The printer 200 detects the moving position of the carriage 210 according to the driving quantity of the stepping motor 223, while checking the paper feed position based on the data from the encoder 242. The printer 200 expands the processed data output from the computer PC into dot on-off data representing ink ejection or non-ejection from nozzles of the print heads 211 through 216 and actuates the drive buffer 256 and the output divider 259.

The control circuit 222 transmits data by wireless to and from the storage process modules 121 through 126 attached to the ink cartridges 111 through 116 via the receiver transmitter unit 230 connecting with the PIO 254. The receiver transmitter unit 230 accordingly has an RF conversion element 231 that converts signals from the PIO 254 into alternating current (AC) signals of a fixed frequency, and a loop antenna 233 that receives the AC signals from the RF conversion element 231. When the loop antenna 233 receives the AC signal, the electromagnetic induction excites an electric signal in another antenna located close to the loop antenna 233. The distance of wireless communication is restricted in the printer 200, so that electromagnetic induction-based wireless communication technique is adopted in the structure of this embodiment.

Figure 5:
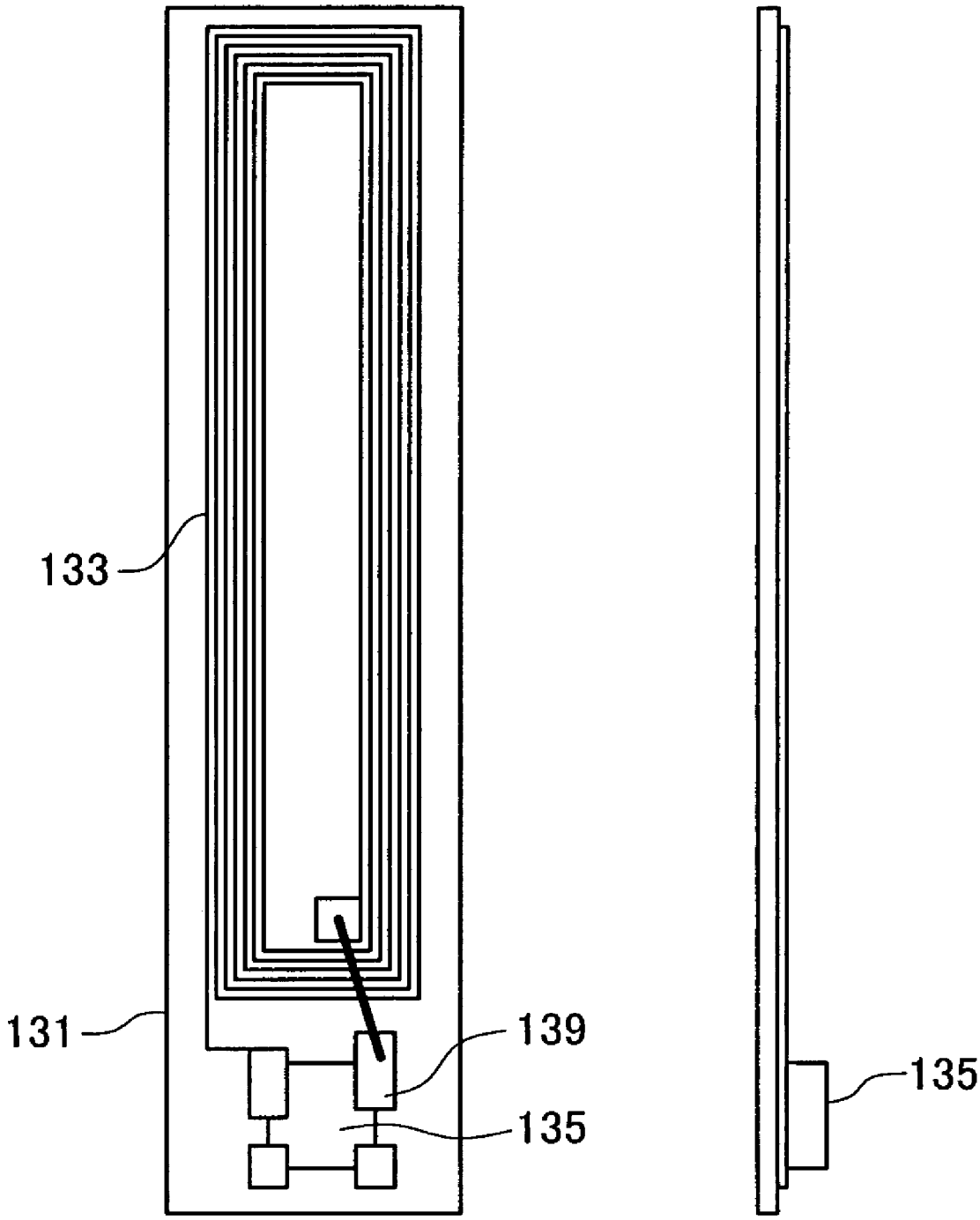
FIG. 5 shows the appearance of a storage process module in the embodiment.

The following describes the structure of the storage process module 121 attached to the ink cartridge 111. FIG. 5 is a front view and a side view showing the storage process module 121. The storage process modules 121 through 126 mounted on the respective ink cartridges 111 through 116 have an identical structure, except ID numbers stored therein. The discussion accordingly regards the storage process module 121 as an example. As illustrated, the storage process module 121 has an antenna 133 formed as a metal thin film pattern on a thin film substrate 131, an exclusive IC chip 135 having diverse functions built therein as discussed later, and a wiring pattern 139 that mutually connects these constituents.

Figure 6:
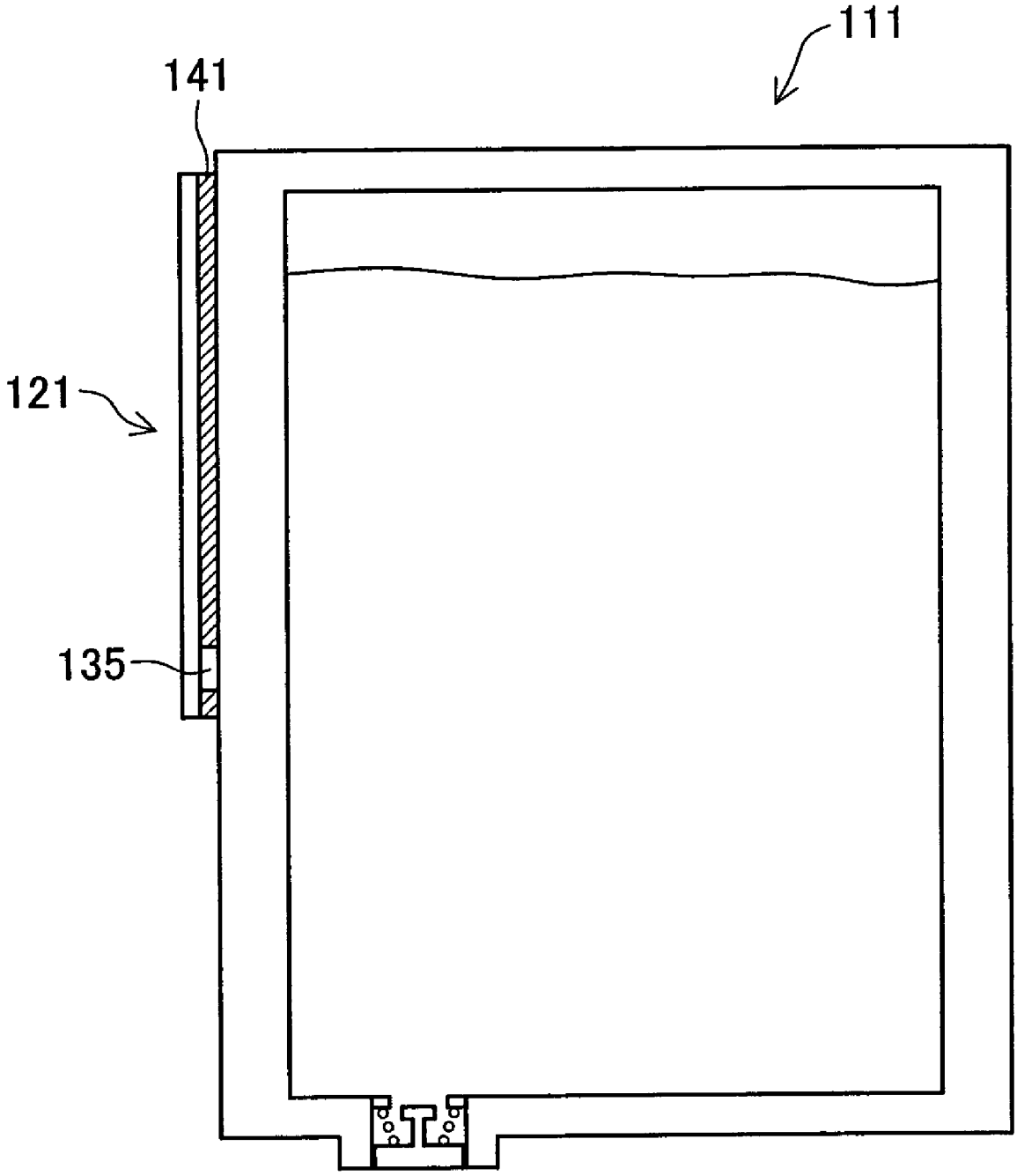
FIG. 6 is an end view showing attachment of the storage process module to an ink cartridge in the embodiment.

FIG. 6 is an end view showing attachment of the storage process module 121 to the ink cartridge 111. The storage process module 121 is fixed to the side face of the ink cartridge 111 by means of an adhesive layer 141 of, for example, an adhesive or a double-faced tape. The attachment position of the storage process module 121 is not restricted to the side face of the ink cartridge 111, but may be any arbitrary position, for example, on the top face of the ink cartridge 111. The layout of the receiver transmitter unit 230 for wireless communication is determined according to the attachment position of the storage process module 121.

Figure 7:
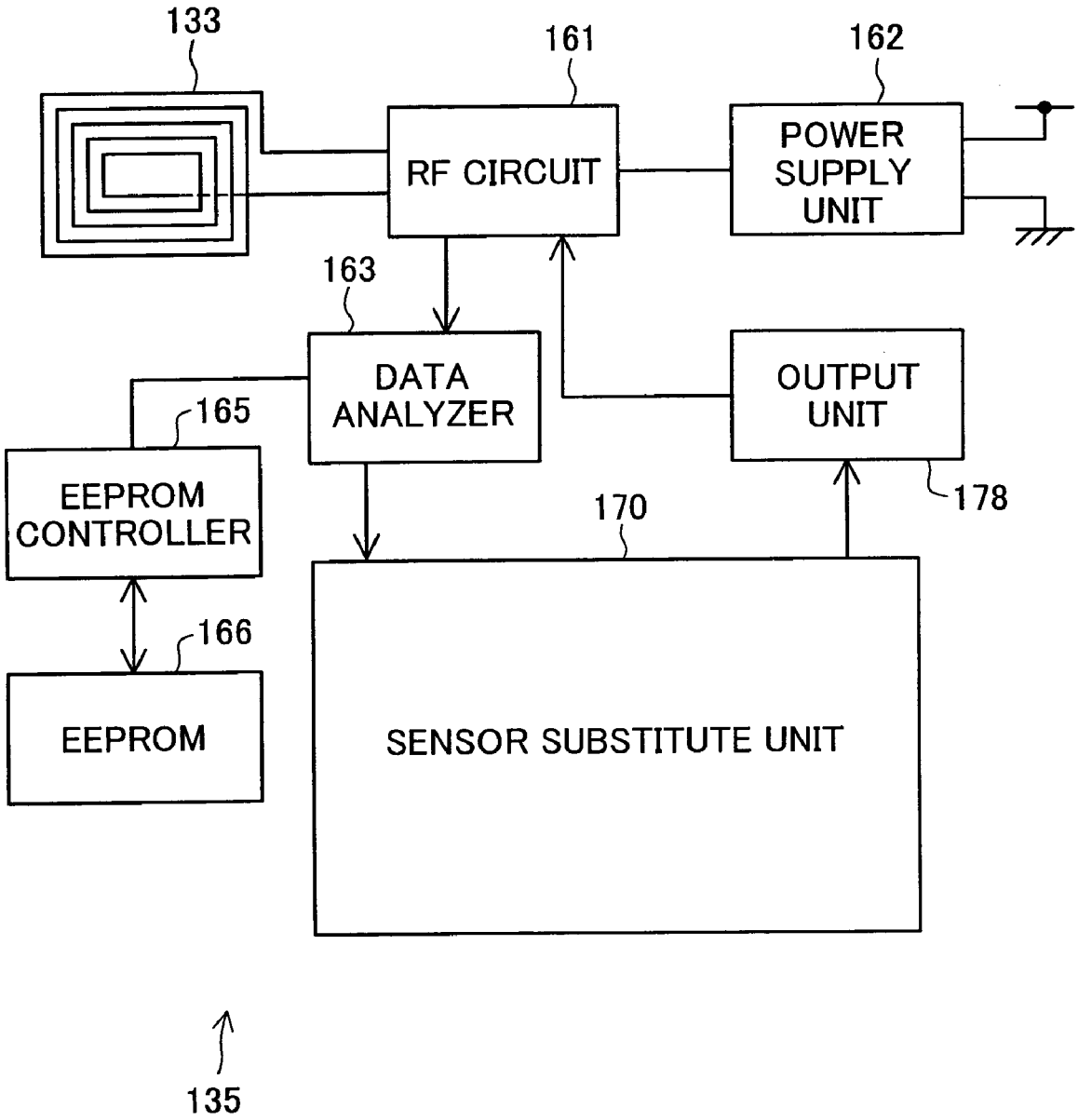
FIG. 7 is a block diagram showing the internal structure of the storage process module.

FIG. 7 is a block diagram showing the internal structure of the storage process module 121. The storage process module 121 has an RF circuit 161, a power supply unit 162, a data analyzer 163, an EEPROM controller 165, an EEPROM 166, a sensor substitute unit 170 and an output unit 178, which are all built in the exclusive IC chip 135.

The RF circuit 161 demodulates an AC signal generated in the antenna 133 by the electromagnetic induction, extracts an electric power component and a signal component from the demodulated AC signal, and outputs the electric power component to the power supply unit 162 while outputting the signal component to the data analyzer 163. The RF circuit 161 also functions to receive a signal from the output unit 178 (described later), modulates the received signal to an AC signal, and transmits the modulated AC signal to the receiver transmitter unit 230 of the printer 200 via the antenna 133. The power supply unit 162 receives the electric power component from the RF circuit 161, stabilizes the received electric power component, and outputs the stabilized electric power component as the power source of the exclusive IC chip 135. No independent power source, such as dry cells, is thus required for each of the ink cartridges 111 through 116 in the structure of this embodiment. When the signal-induced power supply time from the receiver transmitter unit 230 is restricted, the storage process module 121 may additionally have a charge accumulator element, such as a capacitor, that effectively accumulates the stabilized power source generated by the power supply unit 162. The charge accumulator element may be disposed before the power supply unit 162.

Figure 8A:
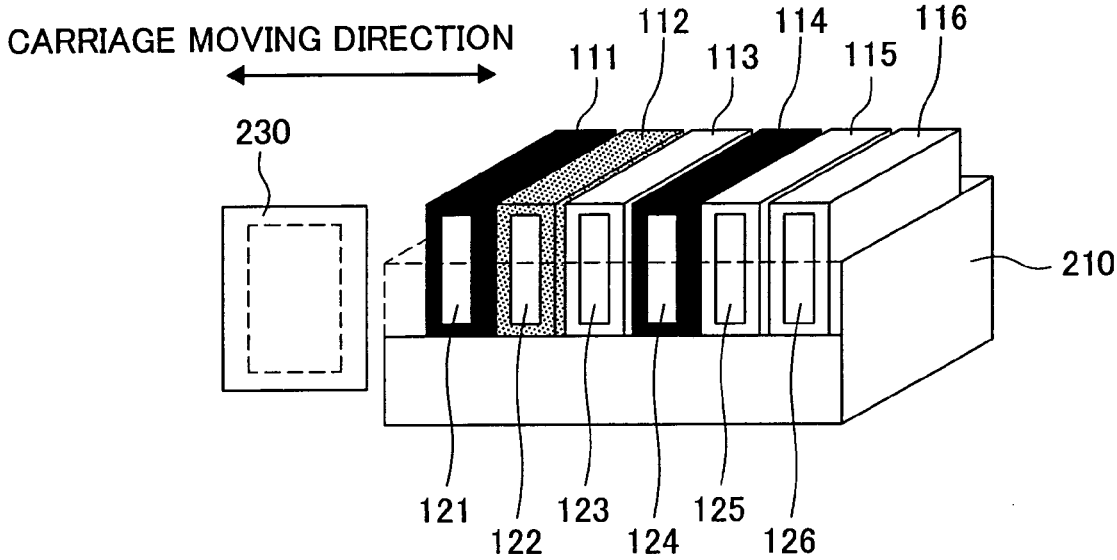
FIGS. 8A and 8B show the positional relation between a receiver transmitter unit and ink cartridges mounted on a carriage of the printer.
Figure 8B:
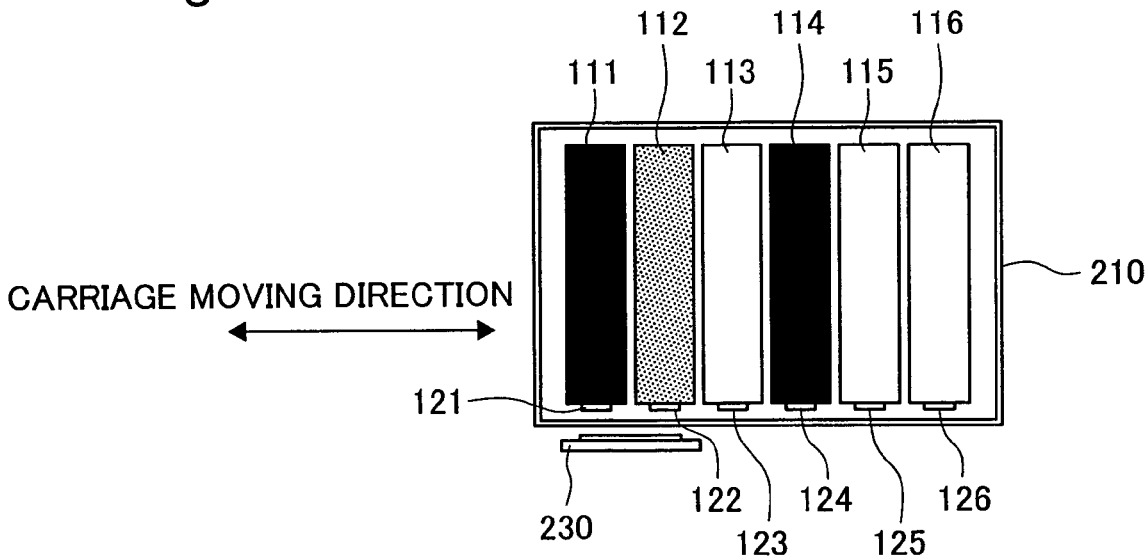

The data analyzer 163 analyzes the signal component received from the RF circuit 161 and extracts a command and data from the analyzed signal component. The data analyzer 163 specifies either data transmission to and from the EEPROM 166 or data transmission to and from the sensor substitute unit 170, based on the result of the data analysis. The data analyzer 163 also carries out identification of the object ink cartridge of the data transmission to and from either the EEPROM 166 or the sensor substitute unit 170. The details of the identification process will be discussed later, but basically the identification process identifies the ink cartridge, based on information representing the location of each ink cartridge mounted on the carriage 210 relative to the receiver transmitter unit 230 as shown in FIGS. 8A and 8B and the ID stored in each ink cartridge. FIG. 8A is a perspective view showing the positional relation between the ink cartridges 111 through 116 with the storage process modules 121 through 126 attached thereto and the receiver transmitter unit 230. FIG. 8B shows the relative widths of the ink cartridges 111 through 116 and the receiver transmitter unit 230.

For identification of the object ink cartridge, the control circuit 222 shifts the carriage 210 to approach to the receiver transmitter unit 230. The location of the carriage 210 facing the receiver transmitter unit 230 is outside a printable range. As shown in FIGS. 8A and 8B, the storage process modules 121 through 126 are attached to the side faces of the respective ink cartridges 111 through 116. The shift of the carriage 210 causes two storage process modules at the maximum to enter a transmittable range of the receiver transmitter unit 230. In this state, the data analyzer 163 receives a request from the control circuit 222 via the receiver transmitter unit 230 and performs identification of the object ink cartridge and subsequent data transmission to and from the EEPROM 166 or the sensor substitute unit 170. The details of the processing will be discussed later with reference to the flowchart.

When data transmission to and from the EEPROM 166 is performed after identification of the object ink cartridge, the data analyzer 163 transfers a specified address for a reading, writing, or erasing operation and specification of the processing, that is, selection of the reading operation, the writing operation, or the erasing operation, as well as data in the case of the data writing operation, to the EEPROM controller 165. The EEPROM controller 165 receives the specified address, the specification of the processing, and the data to be written and outputs the specified address and the specification of the processing to the EEPROM 166, so as to read the existing data from the specified address of the EEPROM 166, write the received data at the specified address of the EEPROM 166, or erase the existing data from the specified address of the EEPROM 166.

Figure 9A:
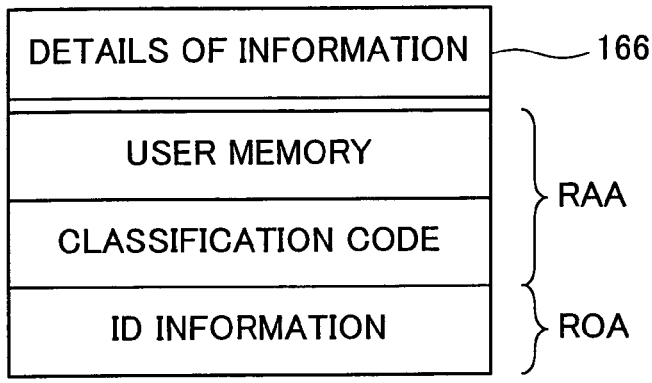
FIGS. 9A and 9B show information stored in an EEPROM as an internal memory of the storage process module.
Figure 9B:
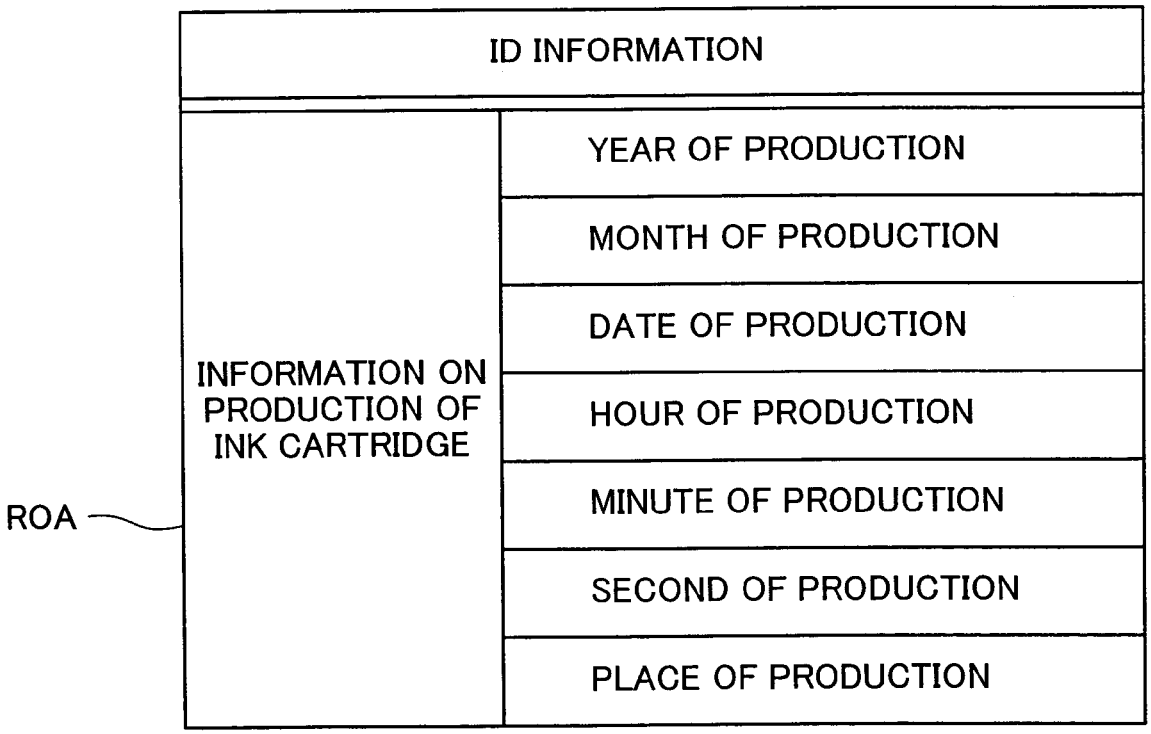

The internal data structure of the EEPROM 166 is shown in FIGS. 9A and 9B. The memory space of the EEPROM 166 is roughly divided into two sections as shown in FIG. 9A. The former section of the memory space is a readable and writable area RAA including a classification code area and a user memory area, which data like the residual quantity of ink are read from and written in. The latter section of the memory space is a read only area ROA which ID information for identifying the ink cartridge is written in.

The ID information is written into the read only area ROA prior attachment of each of the storage process modules 121 through 126 including the EEPROM 166 to the corresponding ink cartridge 111 through 116, for example, in the manufacturing process of the storage process module or in the manufacturing process of the ink cartridge. The printer 200 is allowed to write data into the readable writable area RAA and read and erase the existing data stored in the readable writable area RAA. The printer 200 is, however, not allowed to write data into the read only area ROA, while being allowed to read data from the read only area ROA.

The user memory area of the readable writable area RAA is used to write information regarding the residual quantity of ink in the corresponding ink cartridge 111 through 116. The printer 200 reads the information on the residual quantity of ink and may give an alarm to the user when the residual quantity of ink is below a preset level. The classification code area stores various codes for distinction of the corresponding ink cartridge. The user may use these codes according to the requirements.

The ID information stored in the read only area ROA includes production information on the corresponding ink cartridge, to which the storage process module is attached. A typical example of the ID information regards the year, the month, the date, the hour, the minute, the second, and the place of production of the corresponding ink cartridge 111 through 116 as shown in FIG. 9B. Each piece of the ID information requires a memory area of 4 to 8 bits, so that the ID information totally occupies a memory area of 40 to 70 bits. On each power supply of the printer 200, the control circuit 222 of the printer 200 may read the ID information including the production information of the ink cartridges 111 through 116 from the storage process modules 121 through 126 and give an alarm to the user when any of the ink cartridges has been expired or will be expired soon.

Adequate pieces of information other than the information discussed above may also be stored in the EEPROM 166 of the storage process module 121. The whole area of the EEPROM 166 may be constructed as a readable and writable area. In this case, an electrically readable and writable memory, such as a NAND flash ROM, may be applied for the EEPROM 166 to store the ID information like the production information of the ink cartridge. In the structure of this embodiment, a serial-type memory is applied for the EEPROM 166.

The control circuit 222 may try to access to a sensor module, which is supposed to be mounted on each of the storage process modules 121 through 126. This occurs when the printer 200 carries out control for ink cartridges with built-in sensors but actually has the ink cartridges 111 through 116 without the built-in sensors mounted thereon. The data analyzer 163 receives a detection condition for a sensor from the control circuit 222 and transfers the received detection condition to the sensor substitute unit 170. The sensor substitute unit 170 analyzes the received detection condition and outputs required data. The output data is transmitted from the output module 178 to the control circuit 222 of the printer 200 via the RF circuit 161.

Figure 10:
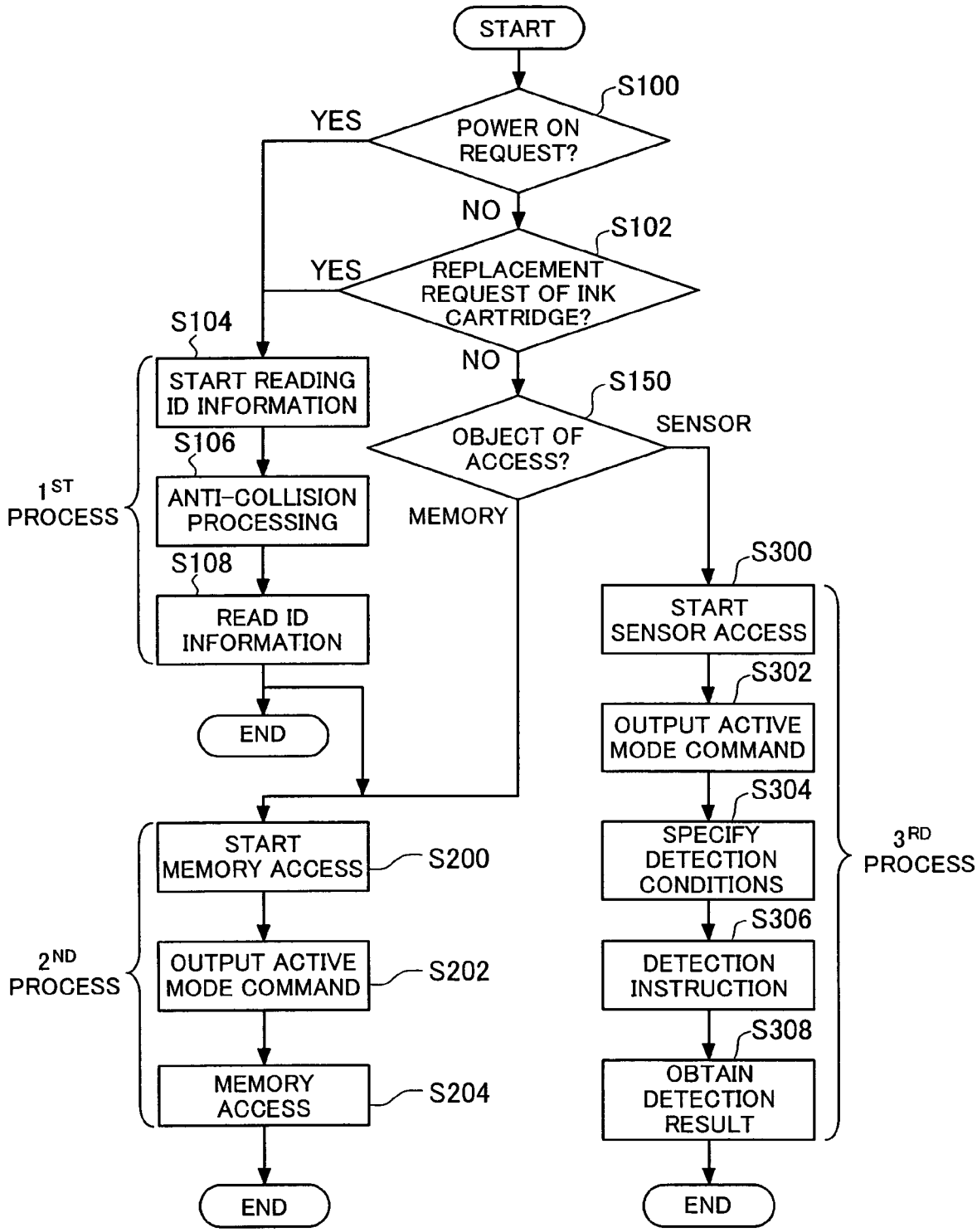
FIG. 10 is a flowchart showing a series of processing executed by the control circuit of the printer in cooperation with the storage process module attached to each ink cartridge.

The following describes the identification of the object ink cartridge and the subsequent access, which are executed by the control circuit 222 of the printer 200 in cooperation with the data analyzer 163 of the corresponding storage process module. FIG. 10 is a flowchart showing a series of processing executed by the control circuit 222 of the printer 200 in cooperation with the storage process module attached to each ink cartridge through communication via the receiver transmitter unit 230. The control circuit 222 of the printer 200 and the data analyzer 163 of each storage process module establish communication via the receiver transmitter unit 230 and carry out an ID information reading process (first process), a memory access process to read information other than the ID information and write information on the residual quantity of ink (second process), and a sensor access process to transmit data to and from the sensor substitute unit 170 (third process).

On each power supply to the printer 200, at the time of replacement of any of the ink cartridges 111 through 116 in the power ON condition, or after elapse of a preset time since previous execution of communication, the printer 200 reads the production information of the ink cartridge and writes and reads the residual quantity of ink into and from a predetermined area in the EEPROM 166. Unlike the general printing process, this series of processing require communication with each of the storage process modules 121 through 126 via the receiver transmitter unit 230.

In order to establish communication with the storage process modules 121 through 126, the carriage 210 with the ink cartridges 111 through 116 mounted thereon is apart from its standard printable area or a right-side non-printable area and is shifted to a left-side non-printable area where the receiver transmitter unit 230 is present. As the carriage 210 moves to the left-side non-printable area, the storage process module approaching the receiver transmitter unit 230 receives an AC signal from the loop antenna 233 of the receiver transmitter unit 230 via the antenna 133. The power supply unit 162 extracts an electric power component from the received AC signal, stabilizes the electric power component, and supplies the stabilized electric power to the respective controllers and circuit elements to activate the controllers and the circuit elements.

When the processing routine starts with communication established between the receiver transmitter unit 230 and each of the storage process modules 121 through 126, the control circuit 222 of the printer 200 first determines whether there is a power ON request (step S100). This step determines whether the power has just been supplied to the ink jet printer 200 to start its operations. When there is a power ON request (in the case of an affirmative answer at step S100), the first process starts to read the ID information from the respective storage process modules 121 through 126 (step S104).

When there is no power ON request (in the case of a negative answer at step S100), on the other hand, the control circuit 222 determines that the printer 200 is carrying out the general printing process and subsequently determines whether there is a replacement request of the ink cartridges 111 through 116 (step S102). The replacement request of the ink cartridges 111 through 116 is output, for example, when the user presses an ink cartridge replacement button 247 on the operation panel 245 in the power ON state of the printer 200. In response to a press of the ink cartridge replacement button 247, the printer 200 stops the general printing process to allow for replacement of any of the ink cartridges 111 through 116. The replacement request is output after actual replacement of any of the ink cartridges 111 through 116.

When there is a replacement request of the ink cartridges 111 through 116 (in the case of an affirmative answer at step S102), the first process starts to read the ID information from the storage process module attached to a replaced ink cartridge (step S104). When there is no replacement request of the ink cartridges 111 through 116 (in the case of a negative answer at step S102), on the other hand, the control circuit 222 determines that the ID information has already been read normally from the respective storage process modules 121 through 126, for example, at the time of power supply and then specifies the object of access (step S150). There are two options, that is, the EEPROM 166 and a sensor module, as the object of access from the control circuit 222. In the structure of this embodiment, however, each of the ink cartridges 111 through 116 does not actually have a sensor module but includes the sensor substitute unit 170 instead. When the control circuit 222 tries to gain access to a virtual sensor module, the sensor substitute unit 170 in each of the ink cartridges 111 through 116 analyzes the access from the control circuit 222 and outputs required data. According to the concrete procedure, when the object of access is the EEPROM 166 (in the case of selection of memory at step S150), the second process starts to gain access to one of the storage process modules 121 through 126 (step S200). When the object of access is a virtual sensor module (in the case of selection of sensor at step S150), on the other hand, the third process starts to read a signal from the sensor substitute unit 170, which substitutes for the virtual sensor module.

The details of the first through the third processes are discussed. The first process is executed when the control circuit 222 detects the power ON request of the printer 200 or the replacement request of the ink cartridges 111 through 116 as mentioned above. The first process starts reading the ID information from the respective storage process modules 121 through 126 (step S104) and carries out anti-collision processing (step S106). The anti-collision processing is required to prevent interferences when the control circuit 222 reads the ID information from the respective storage process modules 121 through 126 for the first time. In the case of any failure or trouble in the middle of the anti-collision processing, the anti-collision processing is carried out all over again. In the structure of the embodiment utilizing wireless communication, the receiver transmitter unit 230 is always communicable with multiple storage process modules (for example, two storage process modules). At the start of communication, the control circuit 222 has not gained yet the ID information of the respective storage process modules 121 through 126 attached to the ink cartridges 111 through 116 mounted on the carriage 210. The anti-collision processing is thus required to prevent interferences at this moment. The anti-collision processing is a known technique and is thus not described here in detail. The receiver transmitter unit 230 outputs a specific piece of ID information. Only a storage process module having ID information identical with the specific piece of ID information responds to the receiver transmitter unit 230, while the other storage process modules fall into a sleep mode. The control circuit 222 of the printer 200 establishes communication with the storage process module of the ink cartridge, which is located in the communicable range and has the identical ID information.

On conclusion of the anti-collision processing, the control circuit 222 causes the data analyzer 163 to read the ID information from the respective storage process modules 121 through 126 (step S108). After reading the ID information, the program may exit from this communication processing routine or may subsequently carry out the second process to access the EEPROM 166.

According to the second process, the control circuit 222 initiates a memory access (step S200) and outputs an active mode command AMC to each of the storage process modules 121 through 126 (step S202). The active mode command AMC is output together with the ID information regarding each of the storage process modules 121 through 126. The data analyzer 163 included in each of the storage process modules 121 through 126 compares the received ID information with the ID information stored in the storage process module and transmits a response signal ACK showing ready for an access to the control circuit 222 only when the received ID information is identical with the stored ID information.

The control circuit 222 gains an actual memory access to the storage process module, which has just transmitted the response signal ACK responding to the output active mode command AMC (step S204). The memory access is implemented to write data at a specified address in the EEPROM 166, to erase the existing data from the specified address in the EEPROM 166, or to read the existing data from the specified address in the EEPROM 166. In any case, the EEPROM controller 165 receives the specified address and the specification of the required processing, that is, the writing operation, the erasing operation, or the reading operation from the control circuit 222 and accesses the specified address in the EEPROM 166 to carry out the required operation.

When the EEPROM controller 165 completes the memory access and outputs an address code signal ADC with a response signal ACK representing completion of the address, the control circuit 222 receives the output signals and terminates the second process.

When the third process starts, the control circuit 222 tries to gain access to a virtual sensor module, which is supposed to be mounted on each of the ink cartridges 111 through 116 (step S300), and outputs an active mode command AMC (step S302) in the same manner as the memory access. Among the storage process modules 121 through 126 of the ink cartridges 111 through 116 that have received the active mode command AMC, the storage process module of the ink cartridge having the ID information identical with the ID information received with the active mode command AMC sends back a response signal ACK showing ready for an access to accept the subsequent processing.

When any of the storage process modules 121 through 126 is activated in response to the active mode command AMC, the control circuit 222 transmits specification of detection conditions to the activated storage process module (step S304). In this embodiment, the detection measures the resonance frequency of a piezoelectric element, and the detection conditions specify a start pulse of the detection of the resonance frequency of the piezoelectric element (for example, the first pulse from the start of the vibration) and the number of pulses corresponding to a detection time (for example, 4 pulses). When the activated storage process module receives the specification of detection conditions and sends back a response signal ACK, the control circuit 222 subsequently outputs a detection instruction (step S306). The detection instruction may be included in the specification of detection conditions.

In response to the detection instruction, the data analyzer 163 of the storage process module 121 analyzes the detection instruction and transfers the analyzed detection instruction to the sensor substitute unit 170. The sensor substitute unit 170 generates a signal simulating detection under the specified detection conditions and outputs the generated signal. In the case of an ink cartridge with a sensor module mounted thereon, a piezoelectric element disposed in a resonance chamber of the ink cartridge is charged and discharged under the specified detection conditions. The charge and discharge excite forcible vibrations of the piezoelectric element. The charge-discharge interval of the piezoelectric element is set to make the frequency of the vibrations excited in the piezoelectric element approximate to the resonance frequency of the resonance chamber in the sensor module. The sensor substitute unit 170 simulates the operations of the virtual sensor module with the piezoelectric element and outputs a signal simulating detection in the status of full ink level in the resonance chamber.

The control circuit 222 of the printer 200 receives the signal output from the sensor substitute unit 170 via the output module 178 (step S308). The structure of this embodiment enables the control circuit 222 to continue the subsequent series of processing, which is originally designed for the ink cartridge with a sensor module, with regard to each of the ink cartridges 111 through 116 without the sensor module. The ink cartridges 111 through 116 do not actually carry out detection of the remaining ink level and thus do not show the actual reduction of the ink level to ½ of the ink chamber or less. The control circuit 222, however, continuously counts and measures the residual quantity of ink by the software. This prevents failed printing with the printer 200.

The ink cartridges 111 through 116 of this embodiment are applicable to both a printer designed for an ink cartridge with a sensor module to actually detect the remaining ink level and a printer designed for an ink cartridge without a sensor module. The arrangement of the embodiment thus enhances the compatibility of the ink cartridge without a sensor module.

The control circuit 222 establishes communication with each of the storage process modules 121 through 126 attached to the ink cartridges 111 through 116 via the receiver transmitter unit 230 in the first through the third processes. The control circuit 222 sequentially communicates with each of the storage process modules 121 through 126 from the left-end storage process module 121 to the right-end storage process module 126. The carriage 210 successively moves by the width of one ink cartridge and establishes communication with the storage process module of each ink cartridge at the stop position. In the structure of the embodiment, the receiver transmitter unit 230 has a width substantially corresponding to the width of two ink cartridges. The carriage 210 may thus move three times by the width of two ink cartridges and establish communication with two storage process modules of two ink cartridges at each stop position. This arrangement desirably reduces the number of the shifting and positioning actions of the carriage 210. In this modified arrangement, the control circuit 222 executes the anti-collision processing to effectively prevent the communication with the two ink cartridges from being interfered with each other.

The embodiment discussed above is to be considered in all aspects as illustrative and not restrictive. There may be many modifications, changes, and alterations without departing from the scope or spirit of the main characteristics of the present invention. For example, the arrangement of the storage process module discussed in the above embodiment is applicable to a toner cartridge, as well as to the ink cartridge of the ink jet printer. The storage process module may be located on the bottom face or the top face of the ink cartridge, in place of the side face. The location of the storage process module on the top face of the ink cartridge desirably heightens the degree of freedom in layout of the receiver transmitter unit 230 and simplifies the whole structure. Since the ink cartridge does not have a built-in sensor, the layout of the storage process module has an extremely high degree of freedom.

In the structure of the above embodiment, the sensor substitute unit 170 substitutes for the sensor that detects the presence or the absence of ink. The sensor substitute unit 170 may substitute for another sensor, for example, a temperature sensor or an ink viscosity sensor. The sensor substitute unit 170 may output or may not output data corresponding to the specified detection condition, together with the signal simulating a detection result. The arrangement of the sensor substitute unit 170 is determined according to the whole series of processing executed in the printer 200 including the processing by the control circuit 222.

Part or all of the circuit structure of the storage process module 121 including the sensor substitute unit 170 maybe actualized by a hardware logic or by a software configuration.

The scope and spirit of the present invention are indicated by the appended claims, rather than by the foregoing description.

What is claimed is:

1. A cartridge that has a chamber to hold a recording material used for printing therein and is mounted on a printing apparatus, said cartridge comprising:

a sensor substitute module that substitutes for a sensor, which is not mounted on said cartridge;

a condition receiving module that receives an external specification of a detection condition for the sensor;

a control module that activates and controls said sensor substitute module, based on the specified detection condition; and an output module that outputs a signal that substitutes for a result of detection and is provided by said sensor substitute module.

2. A cartridge in accordance with claim 1, wherein said sensor substitute module substitutes for a sensor that detects a status of the recording material held in the chamber.

3. A cartridge in accordance with claim 2 , wherein the recording material is a predetermined color ink.

4. A cartridge in accordance with claim 2, wherein the recording material is a toner for any of a photocopier, a facsimile, and a laser printer.

5. A cartridge in accordance with claim 2, wherein said sensor substitute module substitutes for a sensor that detects presence or absence of the recording material in the chamber.

6. A cartridge in accordance with claim 1, wherein said output module outputs the signal substituting for the result of detection by wireless communication.

7. A cartridge in accordance with claim 1, wherein said sensor substitute module generates a signal corresponding to the detection condition received by said condition receiving module.

8. A cartridge in accordance with claim 1, wherein each of said sensor substitute module and said control module are constructed as an arithmetic and logic circuit.

9. A cartridge in accordance with claim 1, wherein said sensor substitute module substitutes for a sensor that detects presence or absence of the recording material in the chamber according to a variation in resonance frequency of a piezoelectric element, and outputs a signal corresponding to a value of the resonance frequency representing the presence of the recording material in the chamber.

10. A cartridge in accordance with claim 9, wherein said condition receiving module receives a specified number of vibrations of the piezoelectric element as the detection condition to measure a time required for the specified number of vibrations, and said control module activates said sensor substitute module to generate vibration-related data corresponding to the time required for the specified number of vibrations.

11. A cartridge in accordance with claim 10, wherein the specified number of vibrations received by said condition receiving module is defined by specified positions of a measurement starting vibration and a measurement terminating vibration, and said control module activates said sensor substitute module to generate the vibration-related data, based on the specified positions of the measurement starting vibration and the measurement terminating vibrations.

12. A cartridge in accordance with claim 1, said cartridge further comprising:

a memory that stores a parameter corresponding to a status of the recording material held in the chamber.

13. A cartridge in accordance with claim 1, said cartridge further comprising:

a wireless communication module that receives and transmits data from and to the outside of said cartridge by wireless communication, wherein the external specification of the detection condition is received via said wireless communication module.

14. A cartridge in accordance with claim 13, wherein said wireless communication module has a loop antenna that effectuates the wireless communication and a power supply unit that utilizes an electromotive force induced in the loop antenna to supply electric power to said cartridge.

15. A printing apparatus with a cartridge mounted thereon, said cartridge having a chamber that holds a recording material used for printing therein, said cartridge comprising:

a sensor substitute module that substitutes for a sensor, which is not mounted on said cartridge;

a condition receiving module that receives an external specification of a detection condition for the sensor;

a control module that activates and controls said sensor substitute module, based on the specified detection condition; and an output module that outputs a signal that substitutes for a result of detection and is provided by said sensor substitute module, said printing apparatus comprising:

a condition specification module that specifies the detection condition;

an input module that receives the signal output from said output module of said cartridge; and a decision module that makes a decision on the assumption of a detection with the sensor, which is not mounted on said cartridge, in response to the input signal.

* * * * *